US005189872A

United States Patent [19]

Mima et al.

[11] Patent Number: 5,189,872

[45] Date of Patent: Mar. 2, 1993

[54] PROCESSING ROBOT FOR A TWO-FOR-ONE TWISTER

[75] Inventors: Hiroshi Mima, Joyo; Tadashi Suzuki, Uji; Yasuhiko Kubota, Kyoto, all of Japan

[73] Assignee: Murata Kikai Kabushiki Kaisha, Kyoto, Japan

[21] Appl. No.: 890,295

[22] Filed: May 27, 1992

Related U.S. Application Data

[63] Continuation of Ser. No. 494,145, Mar. 14, 1990, abandoned.

[30] Foreign Application Priority Data

| | | | |
|---|---|---|---|
| Mar. 17, 1989 | [JP] | Japan | 1-63857 |
| Mar. 20, 1989 | [JP] | Japan | 1-66379 |
| Mar. 28, 1989 | [JP] | Japan | 1-73863 |
| Mar. 28, 1989 | [JP] | Japan | 1-73865 |

[51] Int. Cl.[5] ..... D01H 9/10; D01H 7/86

[52] U.S. Cl. ..... 57/264; 57/58.49; 57/270; 57/279

[58] Field of Search ..... 57/264, 266, 267, 268, 57/269, 270, 271, 276, 278, 279, 281, 58.49, 58.7, 58.83, 90

[56] References Cited

U.S. PATENT DOCUMENTS

| | | | |
|---|---|---|---|
| 3,599,413 | 8/1971 | Nimtz et al. | 57/270 X |
| 4,120,142 | 10/1978 | Franzen | 57/58.7 X |
| 4,848,077 | 7/1989 | Kawarabashi et al. | 57/269 X |
| 4,928,476 | 5/1990 | Otoshima et al. | 57/281 X |
| 4,979,360 | 12/1990 | Kallmann et al. | 57/268 X |
| 4,998,405 | 3/1991 | Frentzel-Beyme | 57/279 |

FOREIGN PATENT DOCUMENTS

| | | | |
|---|---|---|---|
| 2756504 | 6/1979 | Fed. Rep. of Germany | 57/279 |

*Primary Examiner*—Joseph J. Hail, III

*Attorney, Agent, or Firm*—Spensley Horn Jubas & Lubitz

[57] ABSTRACT

The present invention provides an arrangement wherein a carriage is provided so that the carriage may travel along units of a two-for-one twister disposed, the carriage comprising a yarn exchanging mechanism for exchanging an empty yarn package supported on a spindle of each unit with a yarn package, a yarn end fining mechanism for drawing a yarn end from the yarn package, a threading mechanism for inserting the yarn end into an axial hole of the yarn package by an air flow, a doffing mechanism for removing a winding package for full bundles supported on a cradle arm of each unit and supplying a paper tube to the cradle arm, and a yarn engaging mechanism for engaging the yarn end of the yarn package with the paper tube when the cradle arm supports the paper tube.

2 Claims, 13 Drawing Sheets

PROCESSING ROBOT FOR A TWO-FOR-ONE TWISTER

This is a continuation of application Ser. No. 07/494,145 filed on Mar. 14, 1990, now abandoned.

FIELD OF THE INVENTION

The present invention relates to a processing robot for a two-for-one twister, which automatically performs yarn exchanging, yarn end finding, threading, doffing and yarn engagement required by a two-for-one twister.

RELATED ART STATEMENT

In a two-for-one twister, a yarn drawn out of a yarn package supported on a spindle is threaded into an axial hole thereof whereby the yarn is wound on a paper tube supported on a cradle arm while imparting a double twist thereto to form a wound package. When the paper tube winds all the yarns on the yarn package to form a winding package for full bundles, an empty yarn package is exchanged with a full yarn package (yarn exchange), the yarn end is drawn out of the yarn package (yarn end finding) and inserted into the axial hole (threading), the full winding package is removed from the cradle arm and a new paper tube is supported on the cradle arm (doffing), and the yarn end drawn out of the yarn package is secured (engaged) to the paper tube.

In the past, these operations have been exclusively done by hands, taking much time.

However, at present when frequencies of operations such as doffing, yarn exchange and the like increase with recent production of a variety of kinds in a small amount, it is desired that the aforementioned operations are automated in terms of reduction in labor and improvement in productivity.

OBJECT AND SUMMARY OF THE INVENTION

It is therefore an object of the present invention to provide a processing robot for a two-for-one twister which can automatically perform exchange of yarn packages, yarn end finding, threading, doffing and yarn engagement, and which can reduce labor and improve the productivity.

In order to achieve the aforesaid object, the present invention provides an arrangement wherein a carriage is provided so that the carriage may travel along units of a two-for-one twister disposed, the carriage comprising a yarn exchanging mechanism for exchanging an empty yarn package supported on a spindle of each unit with a yarn package, a yarn end finding mechanism for drawing a yarn end from the yarn package, a threading mechanism for inserting the yarn end into an axial hole of the yarn package by an air flow, a doffing mechanism for removing a winding package for full bundles supported on a cradle arm of each unit and supplying a paper tube to the cradle arm, and a yarn engaging mechanism for engaging the yarn end of the yarn package with the paper tube when the cradle arm supports the paper tube.

At the position of the unit with winding completed, the yarn exchanging mechanism first exchanges an empty yarn supported on the spindle with a yarn package. At that time, the yarn end finding mechanism draws out the yarn end from the yarn package. Then, the threading mechanism inserts the yarn end drawn out of the yarn package into the axial hole of the yarn package by the air flow.

On the other hand, the doffing mechanism removes the winding package for full bundles supported on the cradle arm from the cradle arm and supplies the paper tube to the cradle arm. The cradle arm supports the paper tube, and the yarn engaging mechanism engages the yarn end of the threaded yarn package with the paper tube.

Since the exchange of yarn packages, yarn end finding, threading, doffing and yarn engagement are automatically performed in the procedure as described above, the reduction in labor and improvement in productivity can be attained.

DETAILED DESCRIPTION OF PREFERRED EMBODIMENTS

One embodiment of the present invention will be described with reference to the accompanying drawings.

Figure 1:
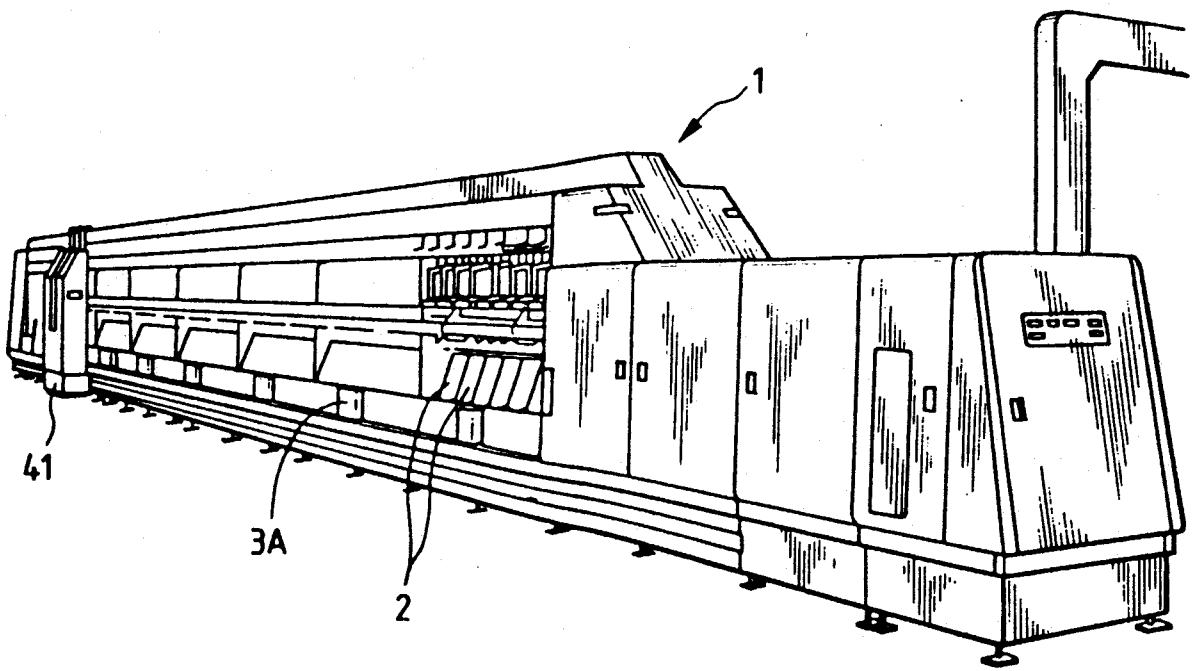
FIG. 1 is a perspective view of the whole two-for-one twister showing one embodiment of the present invention.
Figure 2:
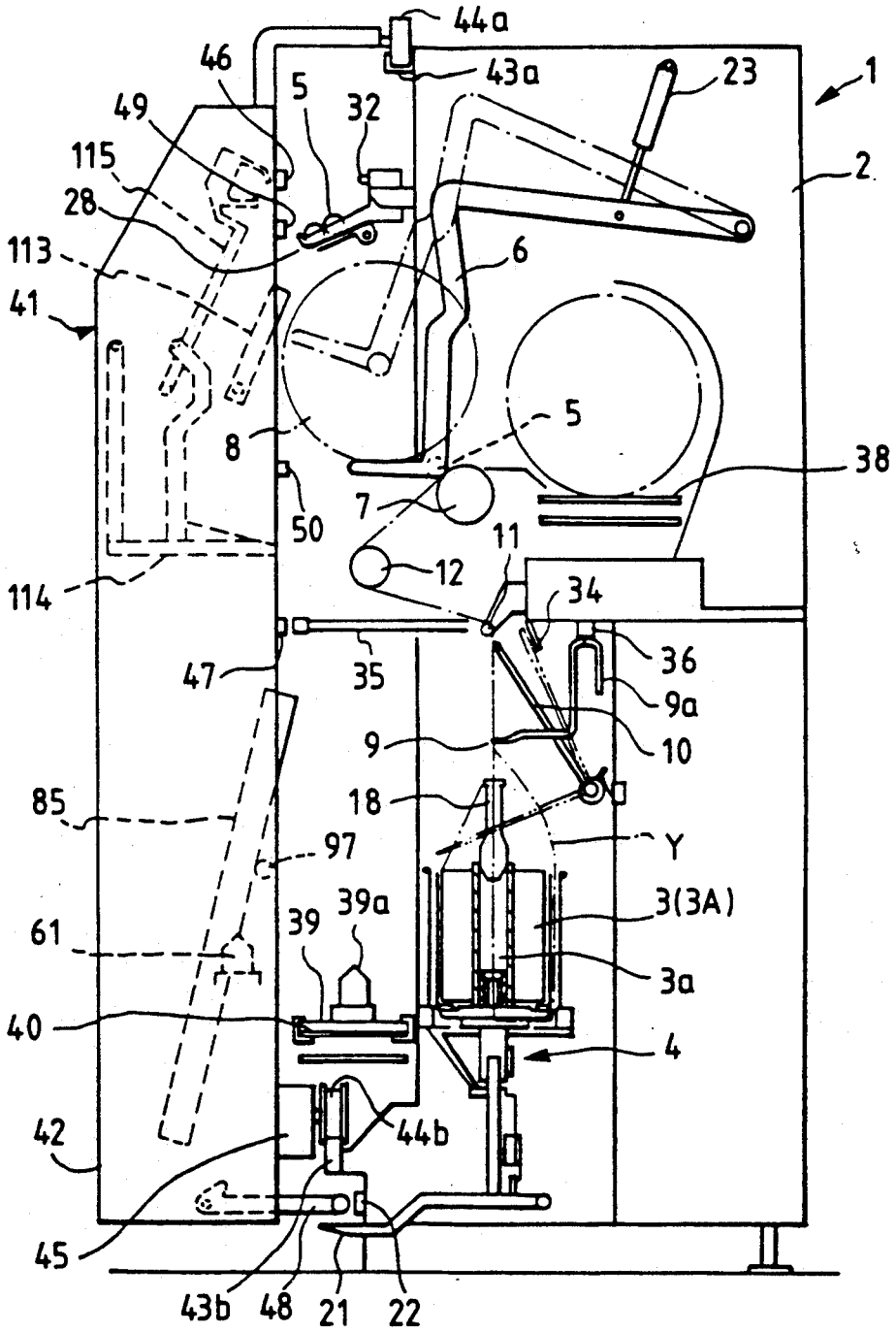
FIG. 2 is an enlarged side sectional view showing the relative structure between units of the two-for-one twister and the processing robot.

As shown in FIGS. 1 and 2, a two-for-one twister 1 comprises a number of units 2 juxtaposed, each unit 2 comprising a spindle 4 for vertically supporting a yarn package 3 at the lower part, and a cradle arm 6 for horizontally supporting a paper tube 5 at the upper part, whereby a yarn Y drawn out of the yarn package 3 is threaded into an axial hole 3*a* thereof and guided upwardly while imparting a double twist thereto, and the paper tube 5 rotatively driven by a rotary drum 7 is wound to form a winding package 8. Upwardly of the yarn package 3 are arranged a snail wire 9 for guiding a yarn, a drop wire 10 for detecting the presence or absence of yarn Y, a yarn guide roller 11 and a feed roller 12 for supplying the yarn Y to the winding package 8 in said order.

Figure 12A:
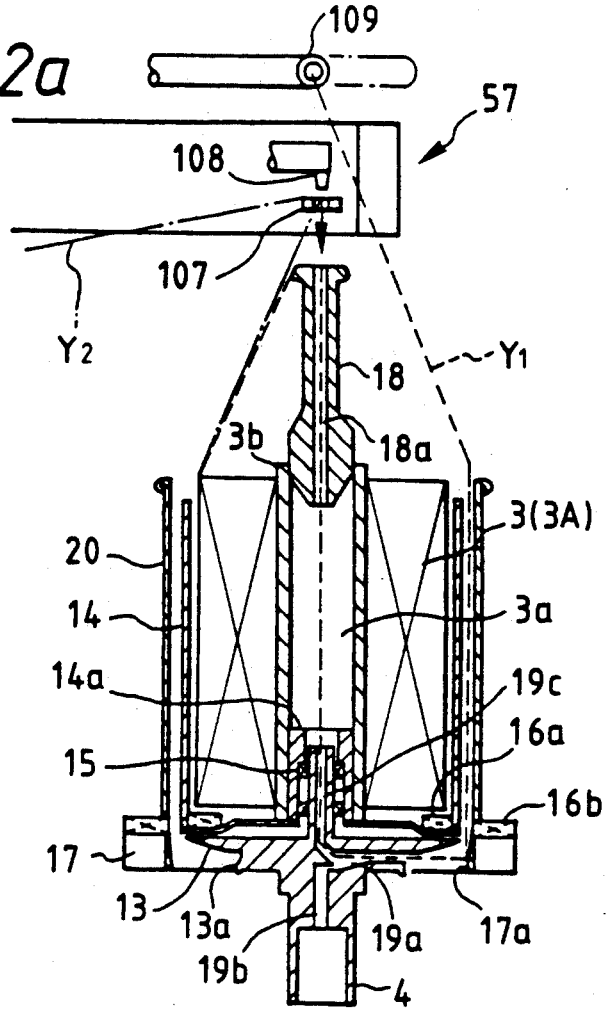
FIG. 12*a* is an enlarged sectional view showing the threading.

As shown in FIG. 12*a*, the spindle 4 is integrally provided with a rotary disk 13 having a yarn storing portion 13*a* for temporarily winding the yarn Y on the outer periphery, and a stationary tubular member 14 for receiving the yarn package 3 is rotatably supported through a bearing 15 on the spindle 4 projected upwardly of the rotary disk 13. The stationary tubular member 14 is maintained at its stationary state irrespective of the rotation of the spindle 4 by attraction action of a magnet 16*a* provided on the bottom and a magnet 16*b* provided on a fixed ring 17 encircling the magnet 16*a*.

The yarn package 3 is stood upright on a boss portion 14*a* projected on the bottom. To the upper end of the yarn package 3 is mounted a tenser cap 18 having a center hole 18*a* for guiding the yarn Y drawn out of the yarn layer to the axial hole 3*a* of the yarn package 3.

The yarn storing portion 13*a* of the rotary disk 13 is radially formed with a yarn guide hole 19*a*. The spindle 4 is formed with a jet hole 19*b* for injecting compressed air into the yarn guide hole 19*a* and a suction hole 19*c* for sucking the yarn Y1 into the yarn guide hole 19*a* from the axial hole 3*a* due to the ejector effect caused by the jet flow. The yarn end Y1 injected out of the yarn guide hole 19*a* by the compressed air impinges upon an inclined inner surface 17*a* of a fixed ring 17 so as to be blown up between a balloon control tube 20 and the stationary tubular member 14. During the threading, an air flow for threading is formed in the spindle 4 as described above.

As shown in FIG. 2, a pedal 21 is mounted on the lower portion of the unit 2 so that when the pedal 21 is slightly stepped, the spindle 4 is braked and stopped whereas when deeply stepped, compressed air is supplied to the jet hole 19*b*. Upwardly of the pedal 21 is disposed a pressure air supply valve 22 for supplying compressure air to a processing robot 41 which will be described later.

Figure 14:
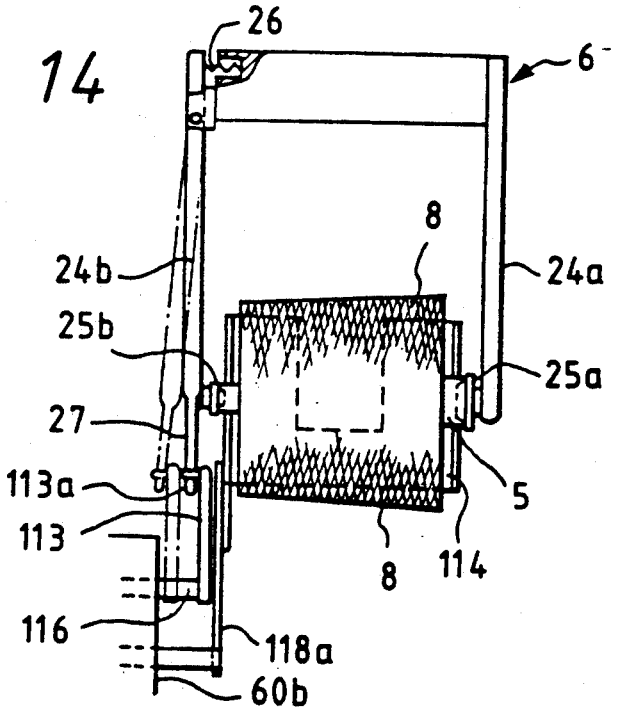
FIG. 14 is a plan view of FIG. 13.

The cradle arm 6 is pivotably supported so as to place the winding package 8 in contact with or to move away from the rotary drum 7, and a cylinder 23 for raising it to a doffing position is connected to the cradle arm 6. Also, as shown in FIG. 14, the cradle arm 6 has at its extreme end a fixed arm portion 24*a* and a movable arm portion 24*b* pivoted open- and closably thereto, and holders 25*a* and 25*b* for supporting both ends of the paper tube 5 are rotatably mounted on both the arm portions 24*a* and 24*b*. To the movable arm portion 24*b* is connected a spring 26 for biasing the former in a closing direction, and a cradle lever 27 is projected to open the movable arm portion 24*b* or press down the cradle arm 6 toward the rotary drum 7.

A stocker 28 having a plurality of paper tubes 5 received therein is mounted above the cradle arm 6, and the stocker 28 is provided with an open- and closable bottom plate 28*a* which is downwardly moved and inclined frontwardly and which can remove the paper tube 5 (see FIG. 15).

Figure 4:
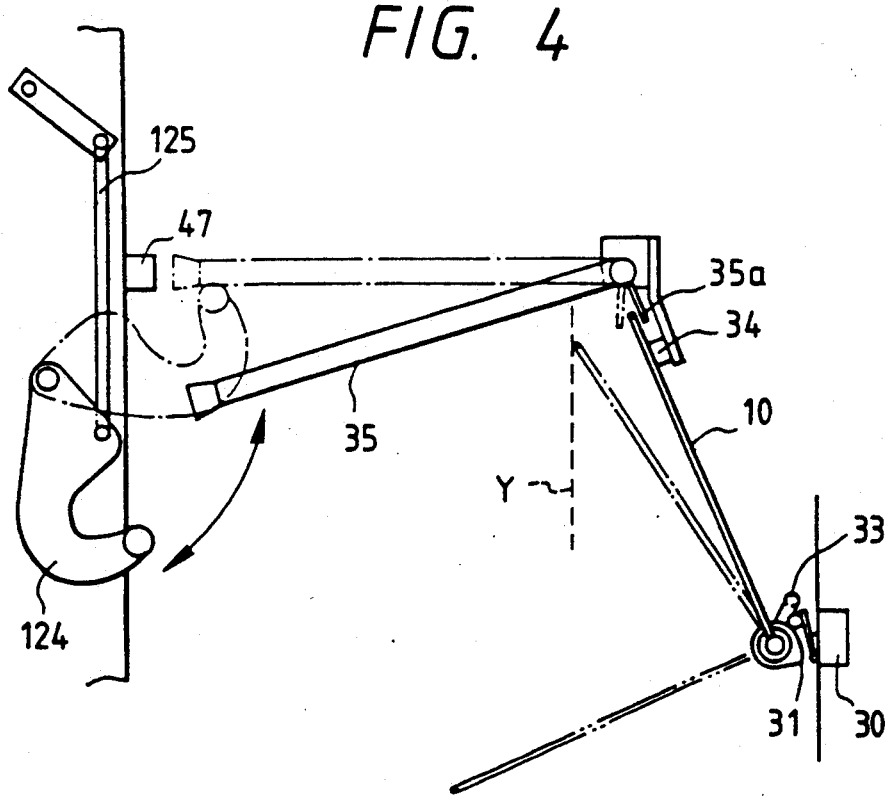
FIG. 4 is a side view showing the relative structure between a drop wire in the unit and a display lever.

The base end of the drop wire 10 is supported on a lateral shaft 29 arranged at the rear of the yarn package 3 as shown in FIG. 4, and the extreme end thereof is stood against the yarn Y between the snail wire 9 and the yarn guide roller 11 and falls by its own weight onto the yarn package 3 when the yarn Y of the yarn package 3 becomes emptied or when yarn cuts occur. A cam 31 for opening and closing an operating valve 30 of a cylinder 23 for the cradle arm is mounted on the base end of the snail wire 9 so that when the drop wire 10 falls, the operating valve 30 is opened and the cradle arm 6 is raised to the doffing position by the cylinder 23. Upwardly of the stocker 28 is mounted a display lamp 32 which is turned on when the cradle arm 6 is raised.

On the base end of the drop wire 10 is provided a turning lever 33 for upwardly turning the former, and upwardly of the position at which the extreme end is stood against the yarn Y is mounted a magnet 34 for keeping the raised drop wire 10 attracted. The base end of a frontwardly horizontally extended display lever 35 is pivoted in the vicinity of the magnet 34, and a press-down lever 35*a* for pressing down the extreme end of the drop wire 10 attracted by the magnet 34 is projected on the base end of the display lever 35 so that when the display lever 35 is returned to a horizontal position as indicated by the phantom line, the drop wire 10 is moved away from the magnet 34 by the press-down lever 35*a* and falls.

The base end of the snail wire 9 is horizontally rotatably supported through a bracket 36 so that it can be escaped rearwardly during the changing of the yarn package 3, and a return lever 9*a* is formed at the base end.

A guide plate 37 for guiding the yarn rearwardly is mounted on the yarn guide roller 11. A conveyor 38 for delivering the doffed winding package 8 and a conveyor 40 for placing the yarn package 3A for full bundles on a tray 39 and carrying it are disposed along the units 2 at the rear of the rotary drum 7 and frontwardly of the yarn package 3, respectively. The conveyor 40 for the yarn package 3A comprises an endless belt 40*a* for placing and carrying the tray 39 and a guide frame 40*b* for guiding the tray 39. A peg 39*a* is provided above the tray 39 to uprightly support the yarn package 3A.

Frontwardly of the units 2 constructed as described above is provided a processing robot 41 free to travel which automatically performs the changing of the yarn package, threading, doffing and yarn engagement. This processing robot 41 is provided with a carriage 42 free to travel along the juxtaposed units 2. Rails 43*a* and 43*b* are mounted at upper and lower portions frontwardly of the unit 2, and carriage 42 is supported for free travel on the rails 43*a* and 43*b* through wheels 44*a* and 44*b*. A travel driving device 45 is connected to the lower wheel 44*b*.

A sensor 46 for detecting the display lamp 32 and a sensor 47 for detecting the display lever 35 are mounted on the carriage 42. When the lighting condition of the display lamp 32 and the horizontal condition of the display lever 35 are simultaneously detected by these sensors 46 and 47, respectively, the travel driving device 45 is decelerated and stopped so that the carriage 42 is located and stopped at the front portion of the unit 2. The carriage 42 is provided at the bottom with an unshown pressure air inlet detachably connected to the pressure air supply valve 22 provided on each unit 2 and a pedal lever 48 which steps the pedal 21, which are operated by a cam type drive mechanism not shown. The pressure air introduced through the pressure air inlet is used a drive source for various cylinders provided on the carriage 42.

Received into the carrier 42 are, as means for detecting the doffing condition, a sensor 49 for detecting the presence or absence of the paper tube 5 within the stocker 28 and a sensor 50 for detecting the presence or absence of the winding package 8 on a winding package delivery conveyor 38 so that when the paper-tube presence condition and the winding-package absence condition are detected by these sensors 49 and 50, respectively, judgement is made that the doffing condition is fulfilled and processes such as the changing of yarn, doffing and the like start.

Figure 5:
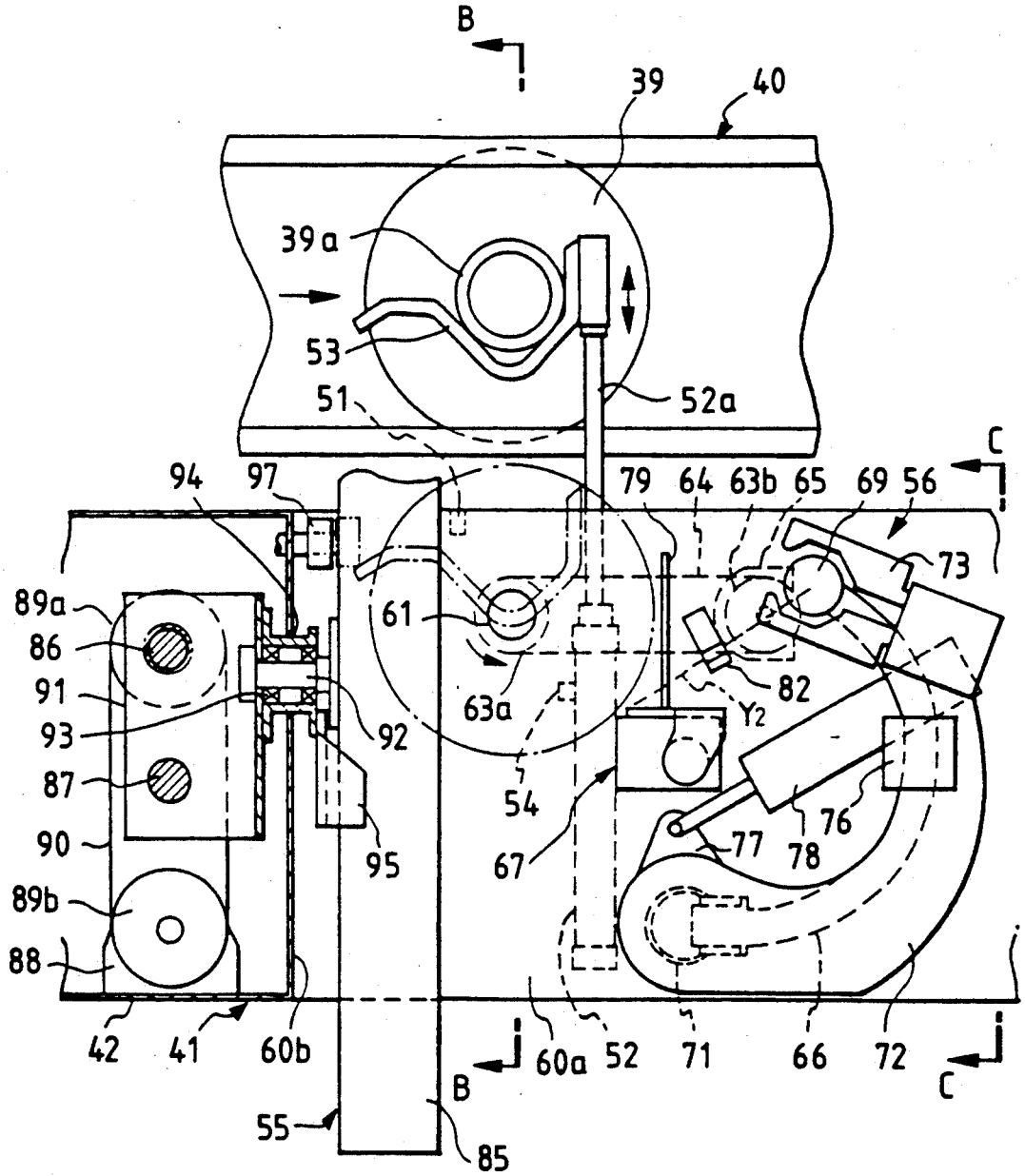
FIG. 5 is a partial plan view of the processing robot.
Figure 8:
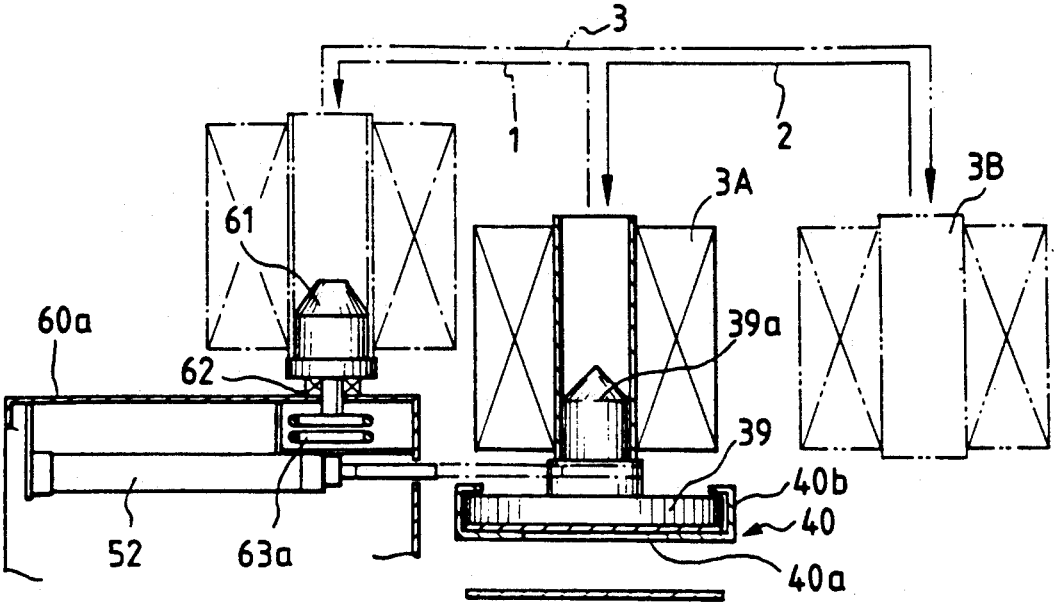
FIG. 8 is a sectional view taken on line B—B of FIG. 5.
Figure 9:
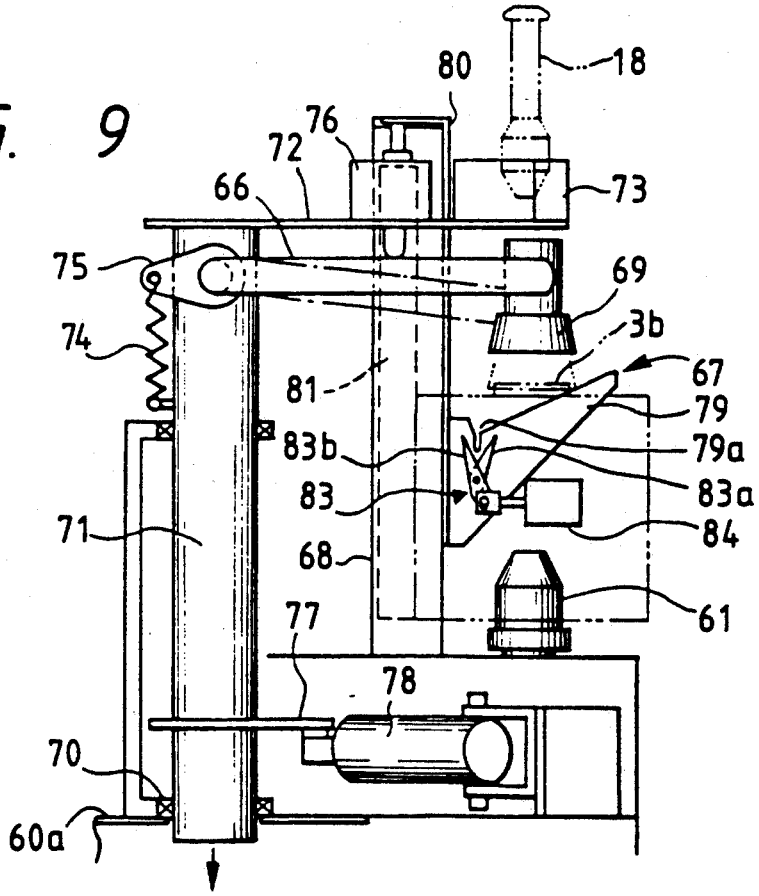
FIG. 9 is a sectional view taken on line C—C of FIG. 5.

As shown in FIGS. 5, 8 and 9, mounted on the carriage 42 are a sensor 51 for detecting a yarn package 3A on the yarn package carrier conveyor 40, and a cylinder 52 for stopping the tray 39 according to a detection signal thereof. A V-shaped engaging member 53 for engaging the base end of a peg 39*a* of the tray 39 is mounted on the extreme end of a piston rod 52*a* of the cylinder 52. A proximity sensor 54 for detecting that the piston rod 52*a* extended a predetermined stroke is mounted on the cylinder 52, and the conveyor 40 is stopped by the detection signal therefrom. In the case where a variety of yarn bobbins are handled, the diameter of the base end of the peg 39A of the tray 39 may be varied according to the kinds. Then, the stroke of the piston rod 52*a* when engaged by the engaging member 53 varies accordingly, and therefore, the stroke may be detected to sort necessary packages.

The carriage 42 is provided with a yarn changing mechanism 55 for changing an empty yarn package 3B supported on the spindle 4 of each unit 2 with a yarn package 3A, a yarn end finding mechanism 56 for drawing the yarn end from the yarn package 3A, a threading mechanism 57 for inserting the yarn end into the axial hole 3*a* of the yarn package 3A by an air flow, a doffing mechanism 58 for removing the winding package 8 for full bundles supported on the cradle arm 6 of the unit 2 and supplying the paper tube 5 to the cradle arm 6, and a yarn engaging mechanism 59 for engaging the yarn end of the yarn package 3A with the empty yarn tube 5 when the cradle 6 supports the paper tube 5. These mechanisms will be described hereinafter

YARN END FINDING MECHANISM

A frame 60 of the carriage 42 is formed into a U-shape in front, and a yarn end finding peg 61 is mounted on a central upper surface portion 60*a* thereof so that the yarn package 3A having been stopped on the yarn package carrier conveyor 40 is temporarily placed thereon for the yarn end finding. If the yarn end finding peg 61 is provided on the processing robot 41 as described above, a temporary placing peg need not be provided on the unit 2, and the yarn end finding process can be made during the temporary placing of the yarn package 3A to increase the processing efficiency. The yarn end finding peg 61, the peg 39*a* of the tray 39 stopped on the conveyor 40 and the spindle 4 are arranged on the same line at right angles to the travelling direction of the carriage 42. The yarn end finding peg 61 is rotatably supported through a bearing 62 and is rotatively driven by a motor 65 through pulleys 63*a* and 63*b* and an endless belt 64 in a direction of delivering the yarn end during the yarn end finding processing.

A yarn end finding suction arm 66 for delivering the yarn end from the yarn package 3A stood upright on the yarn end finding peg 61 and a yarn carrying portion 67 for carrying the yarn subjected to the yarn end finding are disposed on the upper surface portion of the frame 60. The suction arm 66 is formed into a circular configuration so as not to interfere with a support frame 68 of the yarn carrying portion 67, and a suction mouth 69 capped on the upper end 3*b* of the paper tube of the yarn package 3A to suck and find the yarn end bunch-wound on the upper end of the paper tube is mounted on the extreme end of the suction arm 66. The base end of the suction arm 69 is rotatably connected to the upper side of a suction tube 71 stood upright and rotatably supported through a bearing 70 on the upper surface portion 60*a* of the frame 60, and the lower end of the suction tube 71 is connected to a blower not shown mounted on the carriage 42.

A receiving arm 72 formed to be circular along the suction arm 66 is secured to the upper end of the suction tube 71, and a cap chucker 73 for detachably holding a tenser cap 18 is mounted on the extreme end of the receiving arm 72.

A spring 74 for upwardly urging the suction arm 66 so as to move the suction mouth 69 away from the upper end 3*b* of the yarn package 3A on the yarn end finding peg 61 is connected through a lever 75 to the base end of the suction arm 66, and a pressing cylinder 76 for downwardly pressing the suction arm 66 against the force of spring is mounted on the receiving arm 72.

A turning cylinder 78 is connected through a lever 77 to the lower portion of the suction tube 71 so that the suction mouth 69 causes the suction arm 66 to be turned from the yarn end finding position located upwardly of the yarn end finding peg 61 to the stand-by position directed toward the side.

The yarn carrying portion 67 has a support frame 68 stood upright on the upper surface portion 60*a* of the frame 60. A yarn guide member 79 having an upwardly directed yarn groove 79*a* is supported movably up and down through an elevating frame 80 on the side of the support frame 68, and an elevating cylinder 81 mounted within the support frame 68 is connected to the elevating frame 80. A yarn holding ring not shown for holding a yarn once received so as not to escape it is mounted in the yarn groove 79*a* of the yarn guide member 79. The yarn guide member 79 is designed so as to catch the yarn Y2 subjected to yarn-end finding as indicated by the dotted line of FIG. 5 and extended between the yarn package 3A and the suction mouth 69 at the stand-by position and to change the holding height of the yarn.

A yarn end finding sensor 82 for detecting the presence or absence of the yarn is arranged in the yarn running area of the yarn Y2 extended between the yarn guide member 79 and the suction mouth 69 at the stand-by position so that whether or not the yarn end finding has succeeded according to the presence or absence of the yarn, and in case of success, the next step such as threading takes place whilst in case of not-success, the yarn changing and doffing take place without performing threading to terminate the operation.

A cutter 83 for cutting a yarn within the yarn groove 79*a* is arranged corresponding to the yarn guide member 79 positioned at the lowermost end. This cutter 83 comprises a fixed blade 83*a* and a movable blade 83*b*, the movable blade 83*b* being driven by the cylinder 84.

YARN CHANGING MECHANISM

An operating arm 85 for changing yarns or the like is mounted movably up and down and for elevation on the left inner wall 60*b* of the frame 60. Externally of the left inner wall 60*b* is stood upright and rotatably provided a screw rod 86 and is stood upright a guide rod 87. An elevating motor 88 for rotatively driving a screw rod 86 is connected to the latter through pulleys 89*a* and 89*b* and an endless belt 90. An elevating block 91 vertically moved by rotation of the screw rod 86 is supported on the screw rod 86 and the guide rod 87, and a shaft 92 projected on the left hand at the rear of the operating arm 85 is rotatably supported through a bearing 93 on the elevating block 91. The left inner wall 60*b* is formed with a vertical slit 94 for allowing the vertical movement of the bearing 93 portion, and a stopper 95 engaged with the upper surface at the rear of the operating arm 85 to horizontally support it is mounted on the bearing 93 portion. The extreme end of the operating arm 85 is positioned upwardly of the yarn package 3 on the spindle 4 at the time of the horizontal state, and a remaining yarn detecting sensor 96 for detecting the presence or absence of the remaining yarn of the yarn package 3 is mounted on the extreme end thereof.

On the left inner wall 60*b* of the frame 60 is mounted a stopper 97 which engages the lower surface on the front side of the operating arm 85 which moves downward in a horizontal state to receive the operating arm 85 on the carriage 42 side in an upright state, the stopper 97 being moved in and out by a drive mechanism not shown. Thereby, the operating arm 85 is received so that its extreme end is frontwardly obliquely and upwardly positioned so as not to interfere the units 2 during travel.

Figure 6:
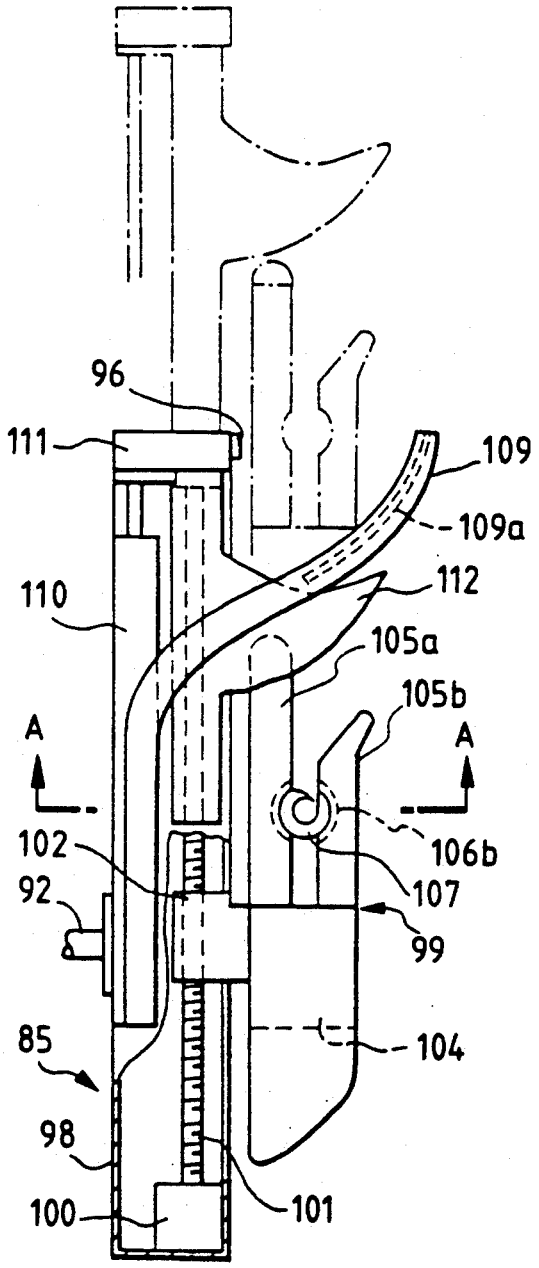
FIG. 6 is a partly sectional plan view showing an operating arm of the processing robot.
Figure 7A:
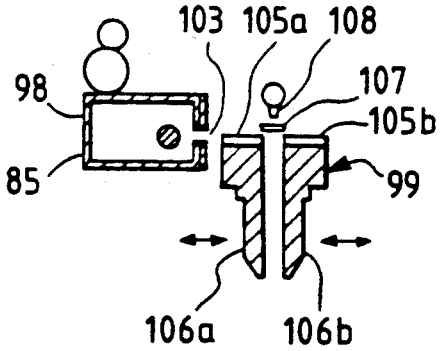
FIG. 7*a* is a sectional view taken on line A—A of FIG. 6.
Figure 7B:
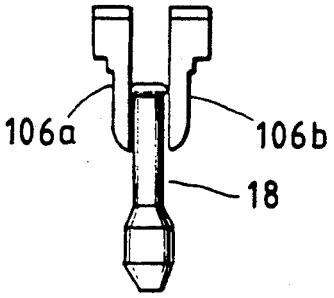
FIGS. 7*b* and 7*c* are a view showing an operation of a chuck member.

As shown in FIGS. 6 and 7*a*, the operating arm 85 has a lengthy box-like frame 98, and a chucker 99 for holding the yarn package 3A and the tensor cap 18 is provided slidably along the length on one side of the frame 98. A screw rod 101 having a motor 100 at one end thereof is supported along the lengthwise within the frame 98 in order to slide and operate the chucker 99, and the side of the chucker 99 is supported on the screw rod 101 through a movable block 102 moved by rotation of the screw rod 101. The frame 98 is formed at the side wall thereof with a horizontal slit 103 for slidably guiding the movable block 102.

The chucker 99 has bifurcated arm members 105*a* and 105*b* opened and closed by the cylinder 104, one arm member 105*a* being used as a pusher for escaping the snail wire 9, the other arm member 105*b* having the extreme end obliquely outwardly extended to catch the yarn. Split chuck members 106*a* and 106*b* are integrally suspended in the lower surfaces of the arm members 105*a* and 105*b*, so that the tenser cap 18 at the inside of both the chuck members 106*a* and 106*b* and the inner surface of the axial hole of the yarn package 3A is pressed and held at the outside of the chuck members 106*a* and 106*b*. As described above, the single chucker 99 is used to hold the yarn package 3A and to hold the tenser cap 18. Therefore, the number of parts is reduced and the apparatus becomes compact.

Figure 7C:
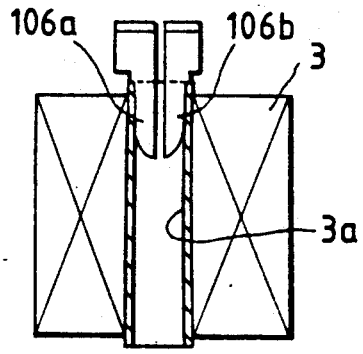

By closing the chuck members 106*a* and 106*b*, the tenser cap 18 can be clamped from the outside therebetween, as shown in FIG. 76. Further, by inserting the chuck members 106*a* and 106*b* into the axial bore 3*a* of the yarn feed package 3 and then opening them, as shown in FIG. 7*c*, the inner surface of the axial bore 3*a* is pressed, thereby the feed package 3 can be clamped. The chuck members 106*a* and 106*b* have a size which permits the tenser cap 18 to be sandwiched between both chuck members when they are closed and also permits both chuck members to be inserted into the axial bore 3*a* of the package 3 when they are closed.

The changing of yarns is carried out by opening and closing the chuck members 106*a* and 106*b*, sliding the chucker 99 and elevating the operating arm 85 whereby as shown in FIG. 8, first, the yarn package 3A on the peg 39*a* of the tray 39 is transferred onto the yarn end finding peg 61 (①), then the empty yarn package 3B on the spindle 4 is transferred onto the peg 39*a* of the tray 39 (②), and subsequently, the yarn package 3A subjected to yarn end finding is transferred onto the spindle 4 from the yarn end finding peg 61 (③), thus completing the changing of yarns.

A yarn holding ring 107 is mounted between both the arm members 105*a* and 105*b* in registration with the axis of the chuck members 106*a* and 106*b*, and a nozzle for injecting compressed air toward the center of the yarn holding ring 107 is mounted on the upper side of the yarn holding ring 107. In threading, the nozzle 108 injects compressed air to insert the yarn end into the axial hole 3*a* together with a suction air flow acting on the axial hole 3*a* of the yarn package 3*a*.

A suction pipe 109 for sucking and holding the yarn end Y1 threaded and blown up between the balloon control tube 20 and the stationary tube 14 is mounted on the operating arm 85 so as to be positioned upwardly of the yarn package 3 on the spindle 4. The suction pipe 109 is formed with a suction slit 109*a* a predetermined length from the extreme end thereof.

On the extreme end of the operating arm 85 is mounted an expansion arm 111 which is expanded forwardly by the operation of the cylinder 110, the extreme end of the expansion arm 111 urging the press-down lever 35*a* of the display lever 35, the turning lever 33 of the drop wire and the return lever 9*a* of the wire 9. A yarn guide member 112 is projected sideway on the expansion arm 111 to guide and pass the yarn Y1 extended between the suction pipe 109 and the yarn package 3 over the snail wire 9; the yarn guide roller 11 and the like.

THREADING MECHANISM

Figure 11:
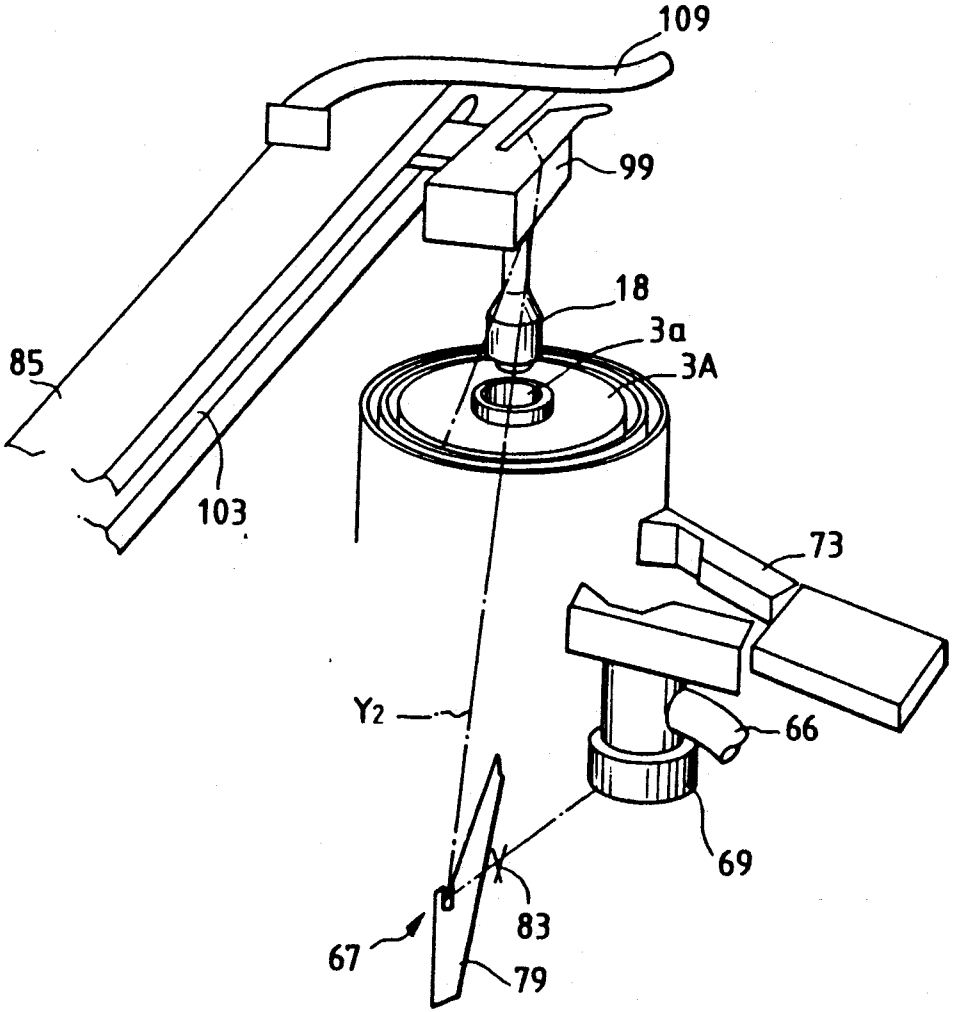
FIG. 11 is a perspective view showing the state where a tensor cap is transferred onto the yarn package by the chucker of FIG. 10.

The threading mechanism 57 is principally composed of a nozzle 108 provided on the chucker 99 of the operating arm 85 and a suction pipe 109 provided on the operating arm 85, whereby threading is carried out together with an air flow for threading produced in the spindle 4 portion. In this case, the yarn end Y2 drawn out of the yarn package 3A mounted on the spindle 4 as the result of changing the yarn as shown in FIG. 11 is in the state sucked by the suction mouth 69 through the chucker 99 of the operating arm 85 and the yarn guide member 79 of the yarn holding portion 67, in which state, when the chucker 99 transports the tenser cap 18 received from the cap chucker 73 onto the yarn package 3A to mount it in the axial hole 3*a*, the double lever 48 deeply steps the pedal 21 of the unit 2 to produce an air flow for yarn end finding in the spindle 4 portion and inject compressed air from the nozzle 108 of the chucker 99. At the same time, when the cutter 83 of the yarn carrying portion 67 cuts the yarn Y2, the yarn end Y1 cut as shown in FIG. 12 is threaded into the axial hole 3a by the action of the air flow and sucked and held by the suction pipe 109, thus completing the threading.

DOFFING MECHANISM

Figure 13:
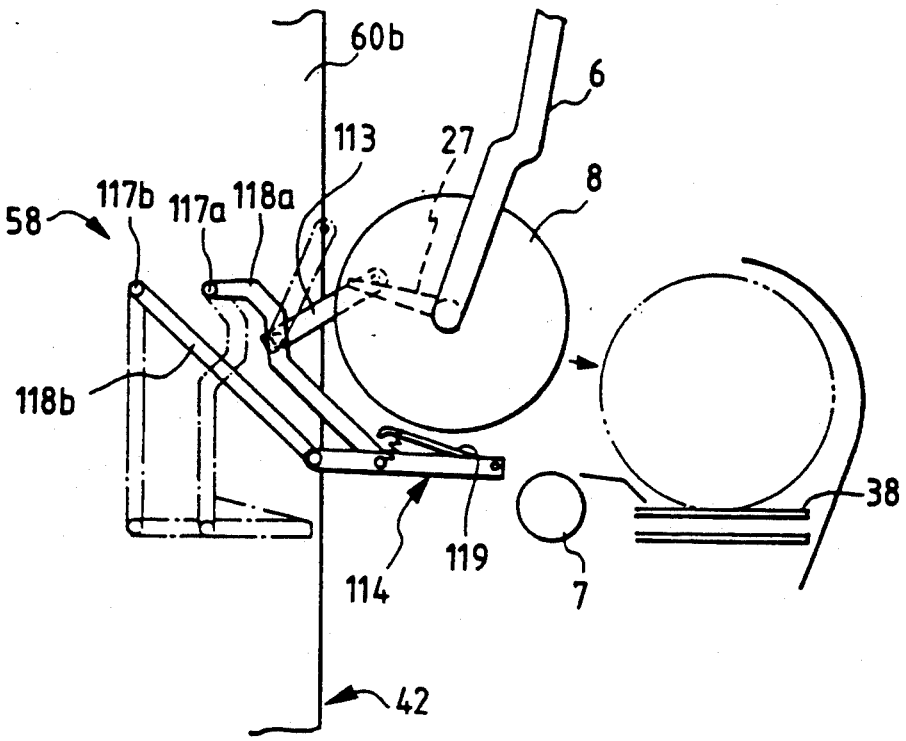
FIG. 13 is a side view showing a doffing mechanism of the processing robot.
Figure 16:
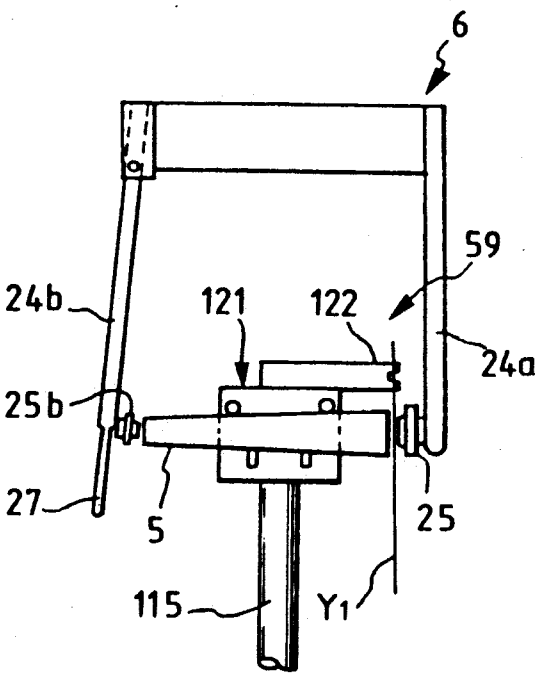
FIG. 16 is a plan view showing the yarn engaging state to the paper tube.

As shown in FIGS. 13 and 14, mounted on the left inner wall 60b of the frame 60 are an operating lever 113 for operating the cradle lever 27 of the cradle arm 6 raised up to the doffing position, a tray 114 for receiving the winding package 8 for full bundles which drops when the movable arm member 24b is opened by the operating lever 113 to roll the winding package 8 on the conveyor 38, and a paper tube supply arm 115 for removing the paper tube 5 from the stocker 28 to supply it to the cradle arm 6 as shown in FIGS. 15 and 16.

The operating lever 113 is mounted on the extreme end of a drive shaft 116 which extends through the left inner wall 60b of the frame 60 and is supported slidably in an axial direction, and a projection 113a in engagement with the upper surface of the cradle lever 27 is provided on the extreme end of the operating lever 113. When not in operation, the operating lever 113 turns above the carriage 42 so as not to interfere with the winding package 8 during the travelling, and during doffing, turns so as to position the inside of the cradle lever 27. Then, the sliding operation causes the cradle lever 27 to move as shown by the phantom line of FIG. 14 so as to open the movable arm member 24b of the cradle arm 6.

The tray 114 is connected and supported through parallel links 118a and 118b on a pair of rotary shafts 117a and 117b which extend through the left inner wall 60b of the frame 60 and are rotatably supported, and a shock absorbing plate 119 for absorbing shocks produced when the winding package 8 falls is mounted on the tray 114 in the state where it is downwardly inclined toward the rotary drum 7. When not in operation, the tray 114 is received on the side of the carriage 42 as indicated by the phantom line of FIG. 13, and during the doffing, extends immediately under the winding package by the rotation of the rotary shafts 117a and 117b.

Figure 15A:
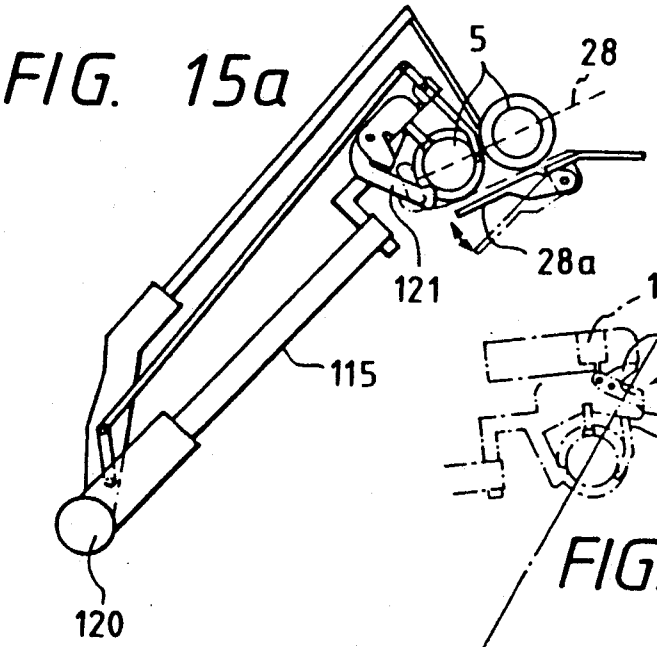
FIG. 15*a* is a side view of a paper tube supply arm of the processing robot.
Figure 15C:
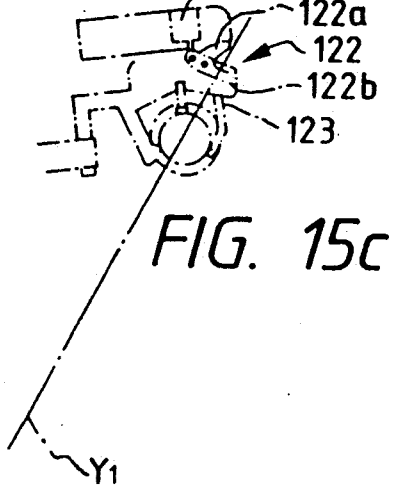
FIGS. 15*b* and 15*c* are views showing movement of a paper tube chucker.
Figure 15B:
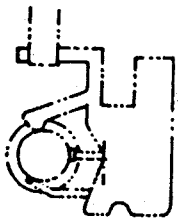
Figure 17:
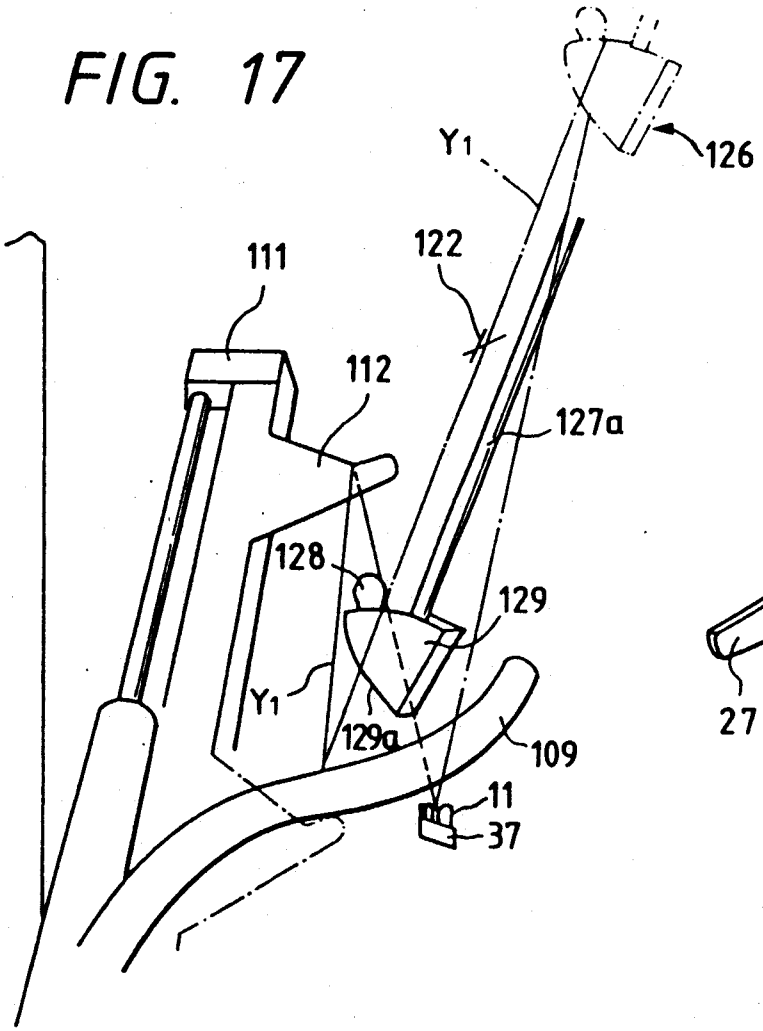
FIG. 17 is a perspective view showing the state where a bunch guide receives a yarn from an operating arm.

The paper tube supply arm 115 is mounted on the extreme end of a rotary shaft 120 which extends through the left inner wall 60b of the frame 60 and is rotatably supported as shown in FIG. 15a, and a paper tube chucker 121 for detachably holding the paper tube 5 is mounted on the extreme end thereof. A clamp cutter 122 is mounted on one side of the paper tube chucker 121. The clamp cutter 122 comprises a fixed blade 122a and a movable blade 122b driven by a cylinder 123, so that the yarn Y1 extended between the suction pipe 109 as indicated by the phantom line of FIG. 17 and a bunch guide 126 which will be described later is cut to hold the yarn end continuous to the yarn package side. After the paper tube 5 has been removed from the stocker 28, the paper tube supply arm 115 turns downward and stands-by FIG. 15b; when the yarn is engaged with the bunch guide 126 as shown in FIG. 17, the arm turns upward so that the yarn is cut by the clamp cutter 122 and the arm 115 stops at the position of the cradle arm 6 FIG. 15c; and after the paper tube 5 has been transferred to the cradle arm 6, the arm 115 turns above the carriage and is received.

The drive shaft 116 of the operating lever 113, the rotary shafts 117a and 117b of the tray 114 and the rotary shaft 120 of the paper tube supply arm 115 are operatively operated by a cam type drive mechanism not shown.

A push-up lever 124 for raising the display lever 35 to a horizontal state as shown in FIG. 4 is supported on the left inner wall 60b of the frame 60, and the push-up lever 124 is operated by a cam type drive mechanism not shown through a link 125.

YARN ENGAGING MECHANISM

The yarn engaging mechanism 59 comprises a paper tube supply arm 115 having a paper tube chucker 121, and a clamp cutter 122 mounted on one side of the paper tube chucker 121 so that when the paper tube supply arm 115 stops at the position of the cradle arm 6 as shown in FIG. 16, the yarn Y1 held and stretched by the clamp cutter 122 is positioned just between one end of the paper tube 5 and one holder 25a, and when the movable arm member 24b is closed to hold the paper tube between both the holders 25a and 25b, the yarn end Y1 is held between one end of the paper tube 5 and one holder 25a to effect the yarn engagement. When the yarn engagement is effected, the clamp cutter 122 releases the yarn end Y1. Since the clamp cutter 122 is provided on the paper tube supply arm 115 as described above, supplying of the paper tube 5 and yarn engaging to the paper tube 5 can be carried out by a simple mechanism.

Figure 18:
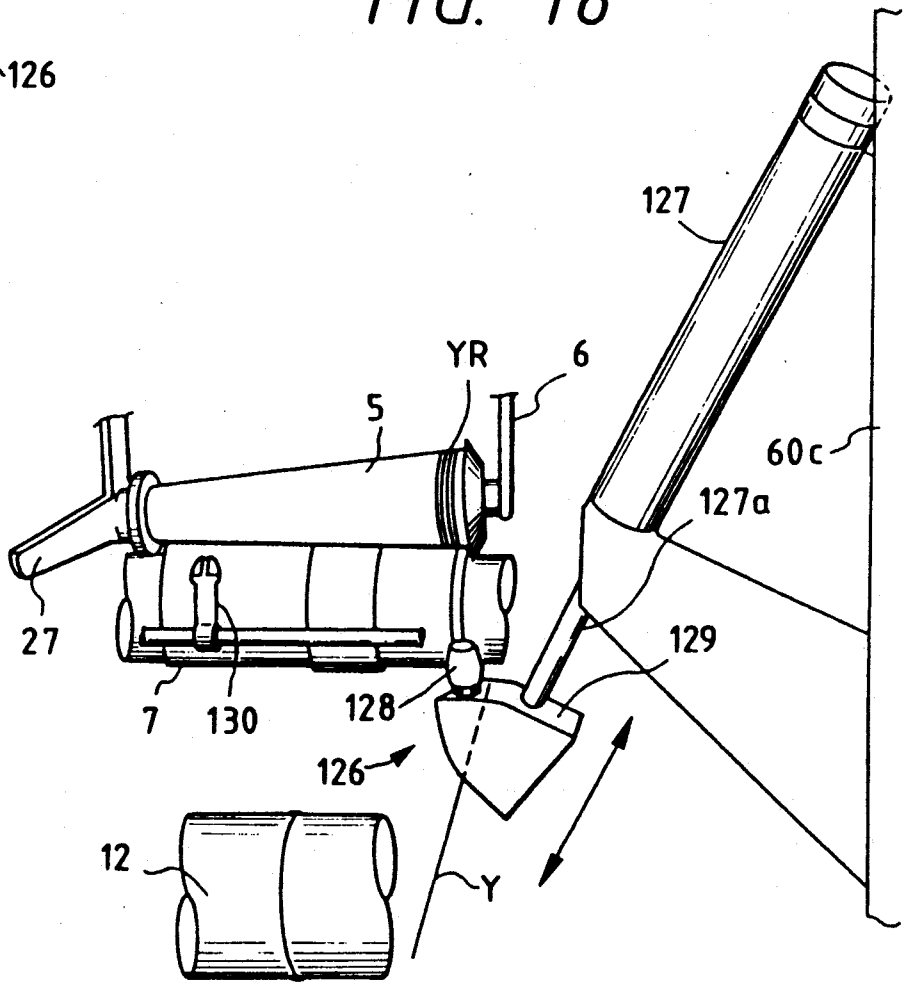
FIG. 18 is a perspective view showing the bunch winding operation by the bunch guide.

As shown in FIGS. 17 and 18, a bunch guide 126 for applying a bunch winding YR to the end of the paper tube 5 is mounted on the right inner wall 60c of the frame 60. The bunch guide 126 has a cylinder 127 mounted on the right inner wall 60c in the state where a piston rod 127a is inclined so as to face the lefthand oblique front portion, and a bunch guide body 129 having an upwardly directed drum-like yarn engaging roller 128 is mounted on the extreme end of the piston rod 127a. When the yarn is engaged with the yarn guide roller 11 on the unit 2 side by the yarn guide member 112, the operating arm 85 is changed in attitude in which it faces obliquely upward portion, in which state, the yarn Y1 extended between the yarn guide roller 11 and the suction pipe 109 is engaged by the yarn guide member 112 to raise it obliquely and upwardly. The bunch guide 126 causes the bunch guide body 129 to moved downward to engage the yarn Y1 extended between the yarn guide roller 11 and the yarn guide member 112 with the yarn engaging roller 128. In this case, an angle of mounting of the cylinder 127 is determined so that the yarn Y1 is positioned above the bunch guide body 129, that is, between the yarn engaging roller 128 and the piston rod 127a, and the bunch guide body 129 is formed at the bottom with a guide surface 129a for upwardly guiding the yarn Y1.

When the bunch guide body 129 moves upward with the yarn Y1 engaged therewith, yarn engagement to the paper tube 5 by the clamp cutter 122 of the paper tube supply arm 115, and the cradle arm 6 is then pressed down by the operating lever 113 and the paper tube 5 comes into contact with the rotary roller 7 and rotates to start winding of the yarn Y. At that time, the yarn Y between the paper tube 5 and the yarn guide roller 11 is in the state where the yarn engages the yarn engaging roller 128 of the bunch guide body 129, in which state, the bunch guide body 129 is moved up and down plural times in a predetermined range whereby the bunch winding YR is applied to the paper tube 5. After bunch winding, the bunch guide 126 causes the bunch guide body 129 to move downward to disengage the yarn from the yarn engaging roller 128 to transfer it to the feed roller 12, then the bunch guide body 129 is raised to the uppermost end to complete the operation. The yarn Y wound on the paper tube 5 through the feed roller 12 is caught by a traverse guide 130 which traverses on the rotary roller 7 for traverse.

Figure 19:
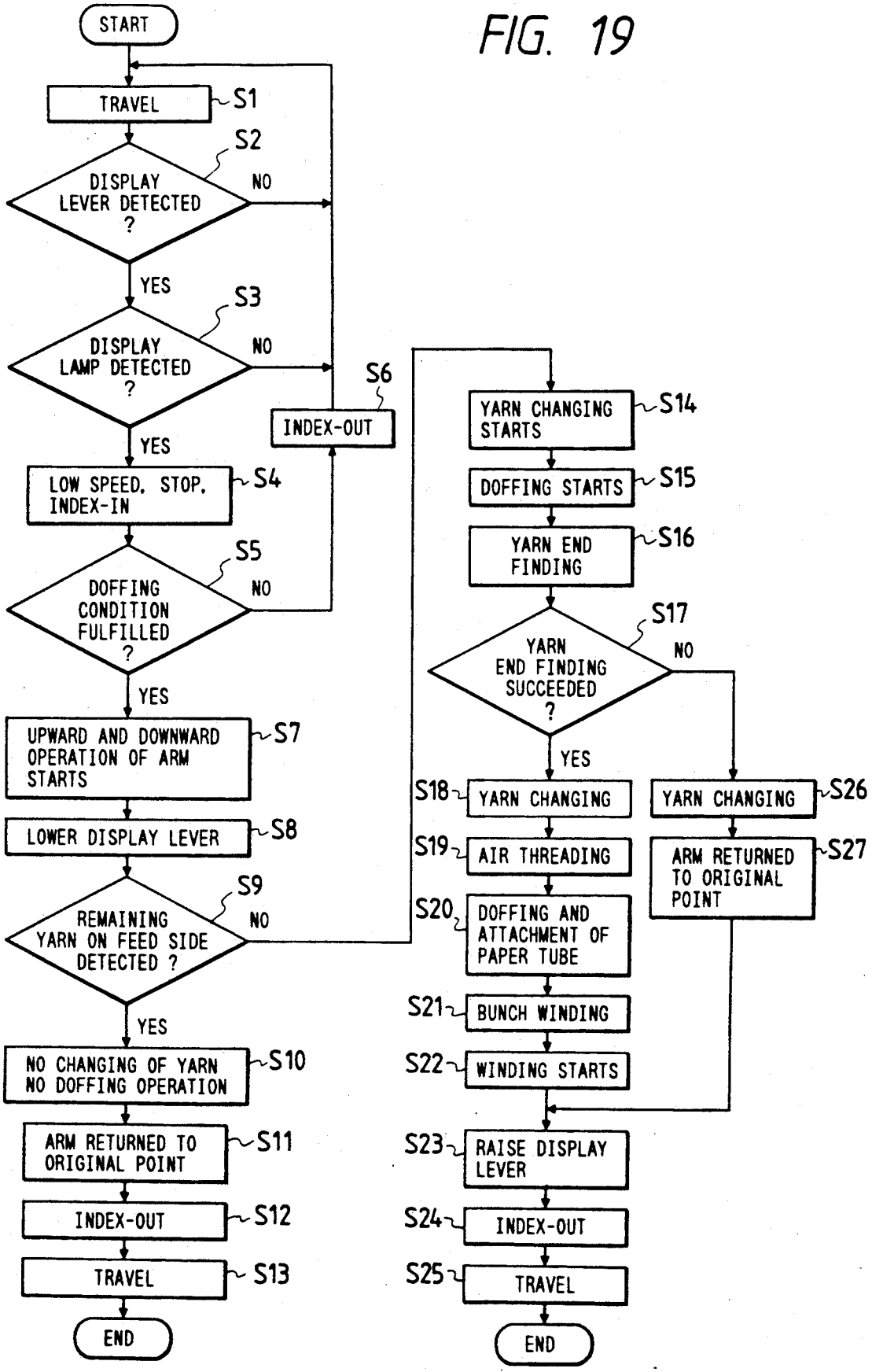
FIG. 19 is a flow chart showing the operation of the processing robot.

The function of the above-described embodiment will be described with reference to a flow chart shown in FIG. 19.

When the processing robot 41 travels along the unit 2 (S1) and the sensors 46 and 47 detect the lighted display lamp 2 and the horizontal-state display lever 35 (S2) (S3), the robot 41 is decelerated and stops in front of the unit 2 to assume an index-in (S4). In this state, the sensors 49 and 50 detect whether or not the doffing condition (the paper tube is present on the stocker, and the winding package is absent on the delivery conveyor) is fulfilled (S5), and in case where the condition is not fulfilled, an index-out is indicated (S6). The travel of the processing robot 41 restarts (S1).

In the case where the doffing condition is fulfilled, the upward and downward operation of the operating arm 85 starts (S7). The double lever 48 slightly steps the pedal 21 to stop the rotation of the spindle 4, and the pressure air inlet portion is connected to the pressure air supply valve 22. The expansion arm 111 of the operating arm 85 pushes the turning lever 33 of the display lever 35 to push down the display lever 35 (S8), and the presence or absence of the remaining yarn on the yarn package 3 is detected by the remaining yarn detecting sensor 96 (S9). In the case where the remaining yarn is present, the yarn changing and doffing operation are not carried out (S10) but the operating arm 85 is returned to the original point and received (S11). An index-out is indicated (S12). The travel of the processing robot 41 restarts (S13).

In the case where the remaining yarn is absent, the yarn changing operation and doffing operation start (S14) (S15).

Figure 3:
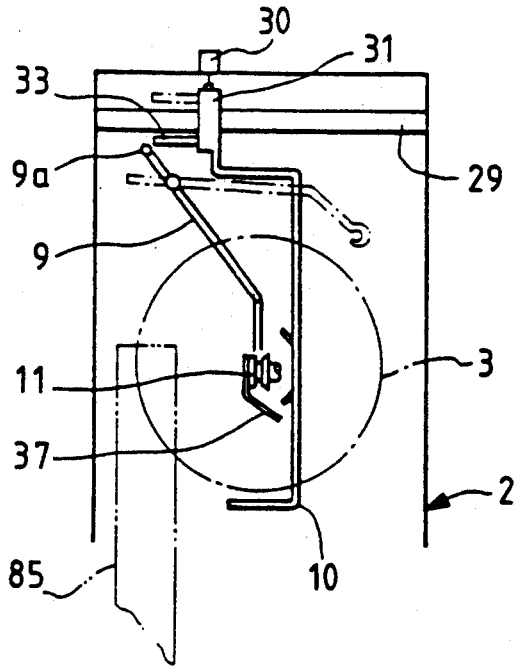
FIG. 3 is a plan view of a yarn package portion of the unit as viewed from top.

In the yarn changing, first, the expansion arm 111 of the operating arm 85 and the left-hand arm member 105*a* of the chucker 99 press the turning lever 33 of the drop wire 10 and the snail wire 9, respectively, to escape them from the yarn package 3 (see FIGS. 3 and 4). When the yarn package detecting sensor 51 detects the yarn package 3*a* on the tray 39 being transported by the conveyor 40, the cylinder 52 is operated as shown in FIG. 5 to bring the engaging member 53 into engagement with the base end of the peg 39*a* of the tray 39, and the conveyor 40 is also stopped by the proximity sensor 54 on the cylinder 52.

Then, the chucker 99 first holds the tenser cap 18 mounted on the empty yarn package 3B on the spindle 4 to transfer it to the cap chucker 73 of the receiving arm 72, and then holds the yarn package 3A on the tray 39 to transfer it to the yarn end finding peg 61 on the processing robot 41 and further holds the empty yarn package 3A on the spindle 4 to transfer it onto the peg 39*a* of the tray 39. When receiving the tenser cap 18, the receiving arm 72 a turned and moved from the stand-by position to the yarn end finding position by the turning cylinder 78, and after receiving, the arm 72 is again returned to the stand-by position.

When the yarn package 3A is mounted on the yarn end finding peg 61, the yarn end finding starts (S16). In this case, the suction arm 66 is turned and moved to the yarn end finding position, and the suction mouth 69 is capped over the upper end 3*b* of the paper tube of the yarn package 3A by the press cylinder 76. Thereby, the suction arm 66 sucks the yarn end bunch wound on the upper end 3*b* of the paper tube from the suction mouth 69, and is returned to the stand-by position.

During that period, the yarn package 3A is rotated in a direction of delivering a yarn through the yarn end finding peg 61 by the motor 65, and the delivered yarn end Y2 is stored in the suction arm 66 and the suction tube 71. Next, the yarn guide member 79 of the yarn carrying portion 67 is moved up and down by the elevating cylinder 81 to catch the yarn Y2 extended between the yarn package 3A and the suction mouth 69 within the yarn groove 79*a* of the yarn guide member 70 through the yarn holding ring, and the yarn Y2 is positioned at the yarn end finding sensor 82.

Figure 10:
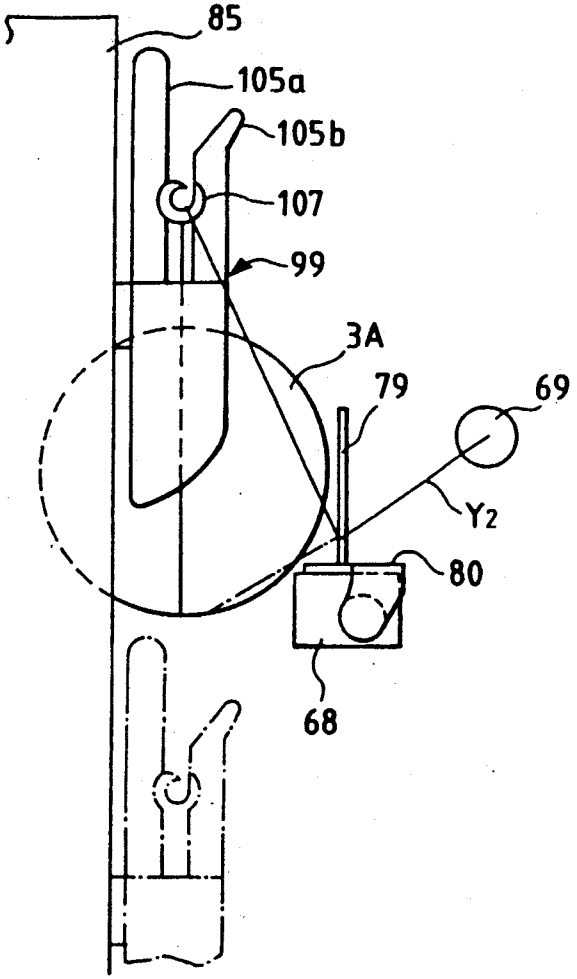
FIG. 10 is a plan view showing the state where a chucker mounted on an operating arm catches a yarn of a yarn package subjected to yarn end finding.

Whether or not the yarn end finding has succeeded according to the presence or absence of the yarn (S17). In case of success, the yarn changing (S18) and threading (air threading) (S19) are carried out in order. That is, as shown in FIG. 10, the yarn Y2 extended between the yarn package 3A and the yarn guide member 70 is caught within the yarn holding ring 107 by the advancement of the chucker 99. Next, the yarn guide member 79 is moved downward, and the chucker 99 holds the yarn package 3A on the yarn end finding peg 61 to transfer it onto the spindle 4, and the tenser cap 18 is received from the cap chucker 73 of the receiving arm 72 turned to the yarn end finding position and mounted on the upper end 3*b* of the paper tube of the yarn package 3A (see FIGS. 11 and 12).

Next, the pedal lever 48 deeply steps the pedal 21 to produce an air flow for threading in the spindle 4 and inject compressed air from the nozzle 108 of the chucker 99, in which state, when the cutter 83 of the yarn carrying portion 67 is actuated to cut the yarn Y2 continuous to the suction mouth 69 from the yarn package 3A, the yarn end Y1 on the side of the cut yarn package is positively sucked into the center hole 18*a* by compressed air flow from the nozzle 108 and sucked flow from the center hole 18*a* of the tenser cap whereby the threading into the axial hole 3*a* can be positively carried out as shown by the dotted line of FIG. 12. The threaded yarn end Y1 is sucked and held by the suction pipe 109.

The threading operation is further described.

Figure 12B:
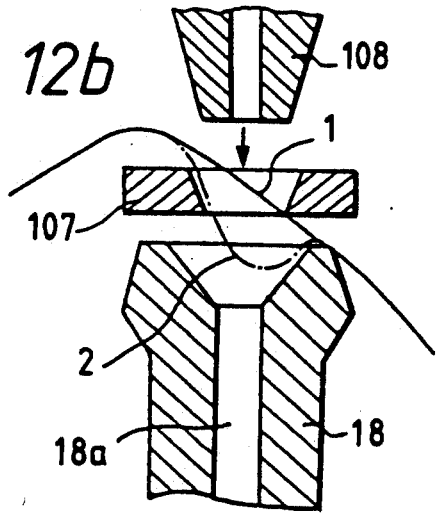
FIG. 12*b* is a sectional view showing a yarn on threading.

As shown in FIG. 12, the yarn feed package 3 is fitted on the boss 14*a* of the stationary cylinder 14, and the yarn end Y2 drawn out from the feed package 3 is sucked and held by the suction mouth 69 (FIG. 9) through the yarn holding ring 107. Further, the tenser cap 18 is fitted in the upper end portion of the axial bore of the feed package 3. In this state, the yarn end Y2 is positioned above the tenser cap 18 through the yarn holding ring 107. Then, the pedal 21 is depressed deep by the pedal lever 48 to create an air current for threading in the spindle 4. As a result, the yarn end (the state of ①) located between the feed package 3 and the yarn holding ring 107 is deflected (the state of ②) toward the central bore 18*a* of the tenser cap 18 by virtue of the suction current, as shown in FIG. 12*b*. In this state, the yarn end Y2 located between the yarn holding ring 107 and the suction mouth is cut by the cutter 83 (FIG. 9). Simultaneously with or just after the said cutting, compressed air is ejected from the nozzle 108 into the axial bore 3*a*. As a result, the feed package-side yarn end Y2 is guided and inserted positively into the central bore 18*a* of the tenser cap by the injection current from the nozzle 108 and the suction current from the said central bore. After the yarn end Y2 has been inserted into the central bore 18*a* of the tenser cap 18, as in the prior art, as indicated by a dotted line in FIG. 12, the yarn end Y2 passes through the axial bore 3*a*, suction hole 19*c* and reaches the yarn guide hole 19*a* under the action of the suction current. Then, at the inner surface 17*a* of the fixed ring 17 the moving direction of the yarn end Y2 is changed upwards by the injection current from the yarn guide hole 19*a* and is thereby blown up between the stationary cylinder 14 and the balloon control cylinder 20. In this way the threading is completed. The yarn end Y1 thus blown up is sucked and held by the suction pipe 109.

As set forth hereinbefore, since a yarn end is inserted into the axial bore of a yarn feed package by the action of both a suction current created within the said axial bore and an injection current from above the axial bore, the yarn end can be inserted positively into the axial bore of the package. Consequently, threading can be carried out easily and that accurately without beforehand insertion of the yarn end into the axial bore, and thus it becomes possible to effect threading using a robot.

Upon completion of threading, the expansion arm 111 presses the return lever 9*a* of the snail wire to return the latter, and the yarn Y between the yarn package 3A and the suction pipe 109 is passed over the snail wire 9 and the yarn guide roller 11 in that order by the yarn guide member 112. Upon completion of yarn engagement, the operating arm 85 returns to the original point to assume the received state.

On the other hand, as shown in FIGS. 13 and 14, the operating lever 113 of the cradle arm 6 turns above the cradle lever 27 to open the movable arm member 24*b* so that the winding package 8 for full bundles is removed from the cradle arm 6, and the tray 114 receives the winding package 8 which extends below the winding package 8 and falls. The winding package 8 is rolled on the rotary drum 7 by its own weight from the inclined shock absorbing plate 119 of the tray 114 and then delivered onto the conveyor 38. The paper tube supply arm 115 turns as shown in FIG. 15, and the paper tube 5 is removed from the stocker 28 by the paper tube chucker 121, and the arm 115 stands-by at the lower position (a). During that period, as shown in FIG. 17, the yarn guide member 112 of the expansion arm 111 pushes up the yarn Y1 between the yarn guide roller 11 and the suction pipe 109, and then the bunch guide 126 causes the yarn Y1 between the yarn guide member 112 and the yarn guide roller 11 to be engaged with the yarn engaging roller 128 of the bunch guide 126 to raise it as indicated by the phantom line. In this state, the paper tube supply arm 115 turns upward, and the yarn Y1 extended between the suction pipe 109 and the yarn engaging roller 128 of the bunch guide body 129 is cut by the clamp cutter 122 to hold the yarn end Y1 continuous to the yarn package, and the arm 115 stops at a position (b) of the cradle arm 6. Since at this time, the yarn end Y1 held and stretched by the clamp cutter 122 is positioned just between one end of the paper tube 5 and one holder 25*a*, when the movable arm member 24*b* is closed by the operating lever 113 and the paper tube 5 is held between both the holders 25*a* and 25*b*, the yarn Y1 is held between one end of the paper tube 5 and one holder 25*a* to effect yarn engagement.

Upon completion of the doffing, attachment of a paper tube and yarn engagement in the manner as described (S20), the cradle arm 6 is pushed down by the operating lever 113. Thereby the display lamp 32 is turned off. The pedal 21 is released from its slight stepped state, and the spindle 4 starts to rotate. When the cradle arm 6 is pushed down, the paper tube 5 comes into contact with the rotary drum 7 and rotates so that the yarn Y is wound on the paper tube 5. At this time, the yarn Y between the paper tube 5 and the yarn guide 11 assumes the state engaged with the yarn engaging roller 128 of the bunch guide body 129. In this state, the bunch guide body 129 is moved up and down plural times in a predetermined range whereby the bunch winding YR is applied to one side of the paper tube 5 (S21). Upon completion of the bunch winding, the bunch guide 126 causes the bunch guide body 129 to be moved downward to disengage the yarn Y from the yarn engaging roller and deliver it to the feed roller 12, then the bunch guide body 129 is raised up to the uppermost end to terminate the operation. The yarn Y wound on the paper tube 5 through the feed roller 12 is caught by the traverse guide 130 which traverses on the rotary drum 7 for traverse, and a full scale winding of yarn starts (S22).

Next, the pressure air inlet portion is disconnected from the pressure air supply valve 22 and the display lever 35 is pushed up by the push-up lever 124 (S23), and an index-out is indicated (S24) whereby the travel of the processing robot 41 restarts (S25). When the display lever 35 is pushed up, the drop wire 10 is moved away from the magnet 34 by the push-down lever 35*a* at the base end thereof and is stood against the travelling yarn Y between wire 9 and the yarn guide roller 11 by the own weight thereof.

In the case where the yarn end finding is not succeeded, the yarn changing, doffing and paper tube supply are effected (S26) and (S27). The operating arm is returned to the original point (S28), after which the display lever is raised (S23), the index-out is indicated (S24) and the travel of the processing robot 41 restarts (S25). Since in this case, the yarn Y is not connected to the paper tube 5 from the yarn package 3A, when the drop wire 10 is moved away from the magnet 34 by pushing up the display lever 35, it falls as it is. The operating valve 30 is opened, the cradle arm is raised and the display lamp 32 is turned on. Therefore, the processing robot 41 again detects the unit 2 to lower the display lever 35 (S8). The detection of the remaining yarn on the feed side is effected (S9). However, since the remaining yarn is present, the yarn changing and doffing operation are not effected (S10), the index-out is indicated (S12), and the travel of the processing robot restarts (S13). Accordingly, an operator may control the unit 2 from which the display lever 35 is down. Since the display lever 35 is down, the processing robot 41 does not any longer stop at the position of the unit 2, and useless operation of the processing robot 41 is avoided.

As described above, according to the present invention, it is possible to automatically perform the changing of yarn packages, yarn end finding, threading, doffing and yarn engagement to relieve labor and enhance the productivity. Furthermore, since these operations are carried out by a single processing robot, the apparatus can be made considerably compact as compared with the case where a processing mechanism is mounted on each unit.

What is claimed is:

1. A yarn exchange and doffing device for use with a two-for-one twister having a plurality of twisting units for producing winding packages, the twisting units having a yarn tube carried by a cradle arm, the twisting units additionally including indicator means for indicating the completion of a yarn end finding operation, the exchange and doffing device comprising:

yarn changing means for exchanging a new yarn feed package for an old yarn feed package;

yarn end finding means for finding a yarn end on the new yarn feed package, wherein the yarn end finding means comprises suction means for applying a suction force to the yarn end and sensor means for sensing the presence of the yarn end;

sensor means for sensing the indicator means;

air flow means for producing an air flow;

threading means for using the air flow to insert the yarn end into an axial hole of the new yarn feed package;

doffing means for removing a full winding package and supplying a new yarn tube to the cradle arm; and yarn engaging means for engaging the yarn end with the yarn tube;

wherein the device will bypass a twisting unit unless the sensor means senses the indicator means.

2. The device of claim 1, wherein the indicator means comprises a display lever, the exchange and doffing device further comprising:

raising means for raising a display lever.

* * * * *